US006017116A

United States Patent [19]

Larson

[11] Patent Number: 6,017,116

[45] Date of Patent: Jan. 25, 2000

[54] METHOD AND DEVICE FOR FEEDING TONER PARTICLES IN A PRINTER UNIT

[75] Inventor: Ove Larson, Västra Frölunda, Sweden

[73] Assignee: Array Printers AB, Sweden

[21] Appl. No.: 08/809,221

[22] PCT Filed: Sep. 18, 1995

[86] PCT No.: PCT/SE95/01053

§ 371 Date: Jun. 2, 1997

§ 102(e) Date: Jun. 2, 1997

[87] PCT Pub. No.: WO96/09171

PCT Pub. Date: Mar. 28, 1996

[30] Foreign Application Priority Data

Sep. 19, 1994 [SE] Sweden ..... 9403144

[51] Int. Cl.[7] ..... B41J 2/06; G03G 15/08

[52] U.S. Cl. ..... 347/55; 399/259

[58] Field of Search ..... 347/55, 120, 123, 347/111, 159, 141, 151, 127, 128, 17, 103, 154, 84, 85, 93, 95; 399/260, 261, 259

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |
| 4,263,601 | 4/1981 | Nishimura et al. . |
| 4,274,100 | 6/1981 | Pond . |
| 4,353,080 | 10/1982 | Cross . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |

(List continued on next page.)

OTHER PUBLICATIONS

E. Bassous, et al., "The Fabrication of HIgh Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

*Primary Examiner*—John Barlow
*Assistant Examiner*—Raqvel Yvette Gordon
*Attorney, Agent, or Firm*—Knobbe, Martens, Olson & Bear, LLP

[57] ABSTRACT

A method and device for charging and feeding toner particles in a printing device include at least one printer unit. The toner unit includes at least one container, one back electrode and one control electrode provided with apertures and electrodes. The toner particles are transported to an information carrier, which is insertable between said container and the back electrode. A toner carrier material is provided substantially coplanar to the electrode unit to dispense toner particles. The toner carrier material is being entirely or partly conductive. The toner carrier material is brought substantially into direct contact with the control electrode unit. The toner particles are successively fed towards the control electrode unit by an external force.

35 Claims, 2 Drawing Sheets

U.S. PATENT DOCUMENTS

| | | |
|---|---|---|
| 4,382,263 | 5/1983 | Fischbeck et al. . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. . |
| 4,498,090 | 2/1985 | Honda et al. . |
| 4,511,907 | 4/1985 | Fukuchi . |
| 4,525,727 | 6/1985 | Kohashi et al. . |
| 4,571,601 | 2/1986 | Teshima . |
| 4,675,703 | 6/1987 | Fotland . |
| 4,717,926 | 1/1988 | Hotomi . |
| 4,743,926 | 5/1988 | Schmidlin et al. . |
| 4,748,453 | 5/1988 | Lin et al. . |
| 4,814,796 | 3/1989 | Schmidlin . |
| 4,831,394 | 5/1989 | Ochiai et al. . |
| 4,837,071 | 6/1989 | Tagoku et al. . |
| 4,860,036 | 8/1989 | Schmidlin . |
| 4,903,050 | 2/1990 | Schmidlin . |
| 4,912,489 | 3/1990 | Schmidlin . |
| 5,028,812 | 7/1991 | Bartky . |
| 5,036,341 | 7/1991 | Larsson . |
| 5,038,159 | 8/1991 | Schmidlin et al. . |
| 5,057,855 | 10/1991 | Damouth . |
| 5,072,235 | 12/1991 | Slowik et al. . |
| 5,083,137 | 1/1992 | Badyal et al. . |
| 5,095,322 | 3/1992 | Fletcher . |
| 5,121,144 | 6/1992 | Larson et al. . |
| 5,128,695 | 7/1992 | Maeda . |
| 5,148,595 | 9/1992 | Doggett et al. . |
| 5,170,185 | 12/1992 | Takemura et al. . |
| 5,181,050 | 1/1993 | Bibl et al. . |
| 5,204,696 | 4/1993 | Schmidlin et al. . |
| 5,204,697 | 4/1993 | Schmidlin . |
| 5,214,451 | 5/1993 | Schmidlin et al. . |
| 5,229,794 | 7/1993 | Honman et al. . |
| 5,235,354 | 8/1993 | Larson . |
| 5,237,346 | 8/1993 | Da Costa et al. . |
| 5,256,246 | 10/1993 | Kitamura . |
| 5,257,045 | 10/1993 | Bergen et al. . |
| 5,270,729 | 12/1993 | Stearns . |
| 5,274,401 | 12/1993 | Doggett et al. . |
| 5,307,092 | 4/1994 | Larson . |
| 5,329,307 | 7/1994 | Takemura et al. . |
| 5,374,949 | 12/1994 | Wada et al. . |
| 5,386,225 | 1/1995 | Shibata . |
| 5,402,158 | 3/1995 | Larson . |
| 5,414,500 | 5/1995 | Furukawa . |
| 5,446,478 | 8/1995 | Larson . |
| 5,450,115 | 9/1995 | Bergen et al. . |
| 5,453,768 | 9/1995 | Schmidlin . |
| 5,473,352 | 12/1995 | Ishida . |
| 5,477,246 | 12/1995 | Hirabayashi et al. . |
| 5,477,250 | 12/1995 | Larson . |
| 5,506,666 | 4/1996 | Masuda et al. . |
| 5,508,723 | 4/1996 | Maeda . |
| 5,515,084 | 5/1996 | Larson . |
| 5,526,029 | 6/1996 | Larson et al. . |
| 5,558,969 | 9/1996 | Uyttendaele et al. . |
| 5,559,586 | 9/1996 | Wada . |
| 5,600,355 | 2/1997 | Wada . |
| 5,614,932 | 3/1997 | Kagayama . |
| 5,617,129 | 4/1997 | Chizuk, Jr. et al. . |
| 5,625,392 | 4/1997 | Maeda . |
| 5,640,185 | 6/1997 | Kagayama . |
| 5,650,809 | 7/1997 | Kitamura . |
| 5,666,147 | 9/1997 | Larson . |
| 5,677,717 | 10/1997 | Ohashi . |
| 5,708,464 | 1/1998 | Desie . |
| 5,774,159 | 6/1998 | Larson . |
| 5,805,185 | 9/1998 | Kondo . |
| 5,818,480 | 10/1998 | Bern et al. . |
| 5,818,490 | 10/1998 | Larson . |
| 5,847,733 | 12/1998 | Bern . |

FOREIGN PATENT DOCUMENTS

| | | |
|---|---|---|
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 04 268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 6/1997 | Japan . |
| 2108432 | 5/1983 | United Kingdom . |
| 9014960 | 12/1990 | WIPO . |
| 9201565 | 2/1992 | WIPO . |

METHOD AND DEVICE FOR FEEDING TONER PARTICLES IN A PRINTER UNIT

This invention relates to a method and device for charging and feeding toner particles in a printing device, including at least one printer unit, consisting of at least one container, one back electrode and one control electrode unit provided with apertures and electrodes, where the toner particles are transported to an information carrier, insertable between said container and the back electrode.

BACKGROUND OF THE INVENTION

U.S. Pat. No. 5,036,341 describes a method and device for generating images on an information carrier, such as paper, by means of an array of control electrodes located between a toner carrier member, so-called developer roller and a back electrode. The control electrode unit consists of a woven mesh of wire electrodes where the spaces between wires become apertures through which toner particles are attracted from the developer roller towards the back electrode. By connecting the control electrodes wires to selectable potentials, the apertures can at least partly be opened or closed electrostatically to passage of toner particles.

U.S. Pat. No. 5,121,144 describes another control electrode unit consisting of a thin insulating substrate with apertures. The apertures are surrounded by ring electrodes on one side of the substrate.

Other types of control electrodes are also known, for example as in UK 2 108 432 where electrodes are located on each side of an insulating substrate. Ring electrodes or the like, at least partly surround each aperture on one side of the substrate while a common electrode surrounds all apertures on the opposite side of the substrate.

FIG. 1 shows, in a schematic way, a cross-section view of a printer unit 10 according to U.S. '341 and '144. The developer roller 12 rotates in a toner container (not show) and attracts toner particles 11 to the roller surface by means of magnetic or electrostatic forces. Toner particles 11 are arranged in a thin layer on the developer roller 12, whose surface may be an electrically conducting or semiconducting material. An electrostatic field is established between the developer roller and a back electrode 15 by for example grounding the developer roller and connecting 1500 volts to the back electrode. That electrostatic field will transport toner particles from the developer roller through the apertures 17 to the surface of an information carrier 13. A control potential of for example −200 volts connected to the control electrodes 16 of an electrode unit 18 will modify the electrostatic field at the developer roller in the region of the control electrode, closing the aperture 17 to passage of toner particles. A control potential of for example +150 volts will modify the electrostatic field at the developer roller in the region of the control electrode, opening the aperture to passage of toner particles from the developer roller through the aperture to the information carrier 13.

Use of a cylindrical developer roller to bring toner particles close to the planar control electrode array causes the distance $l_k$ between the developer roller and each control electrode to depend on the location of the control electrode within the control electrode array. The $l_k$ distance for aperture A1 for example is less than the $l_k$ distance for aperture A4. The variation of $l_k$ distance among the apertures is represented by $\Delta l_k$. Variation of the $l_k$ distance among the control electrodes causes a variation in the electrostatic field for attracting toner particles from the developer roller. An approximate relation of control electrostatic field to the $l_k$ distance is shown in FIG. 2. Variations of the $l_k$ distance cause variations in the control electrostatic field that causes variation in the number of toner particles attracted to the surface of the information carrier.

Those variations of toner particles cause undesirable variation in the printed image.

A means of charging and transporting toner particles is needed that can be made coplanar with the control electrode array so that the $l_k$ distance is more uniform.

THE OBJECT OF THE INVENTION AND IMPORTANT FEATURES

The object of the invention is to provide a method that reduces variation in the distance between the toner delivery means and the control electrode array so that the variation of electric field intensity will be reduced and deterioration of printed images will be avoided.

Above-mentioned problems are solved by providing a toner carrier material coplanar with said electrode unit to dispense toner particles, bringing said material, being entirely or partly conductive, substantially into direct contact with the control electrode unit; and successively feeding the toner particles towards the control electrode unit by means of an external force.

DESCRIPTION OF EMBODIMENTS

Figure 1:
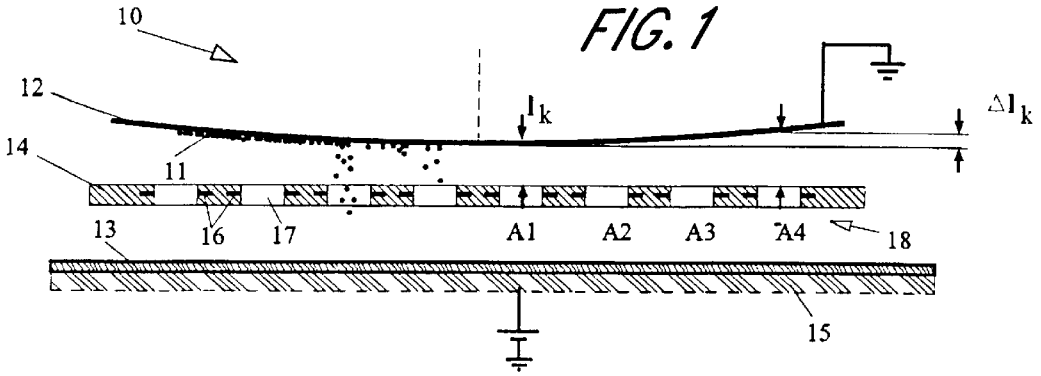
FIG. 1 schematically shows a cross-section view of a section through one embodiment of the prior art technology.
Figure 2:
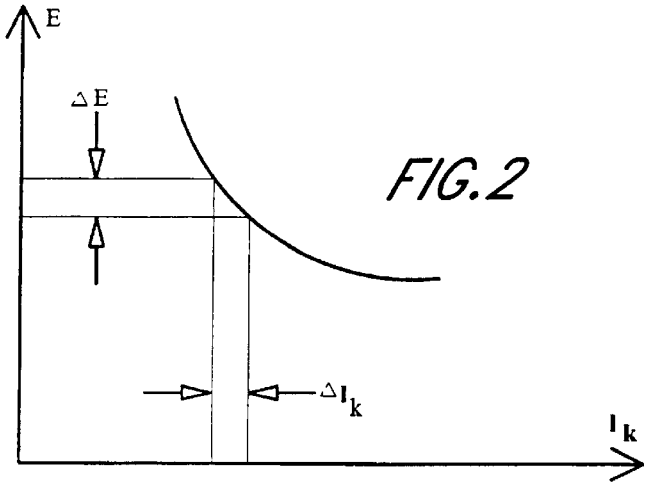
FIG. 2 shows the relation between the $l_k$ distance and the electrostatic control field in a printer unit according to FIG. 1.
Figure 3:
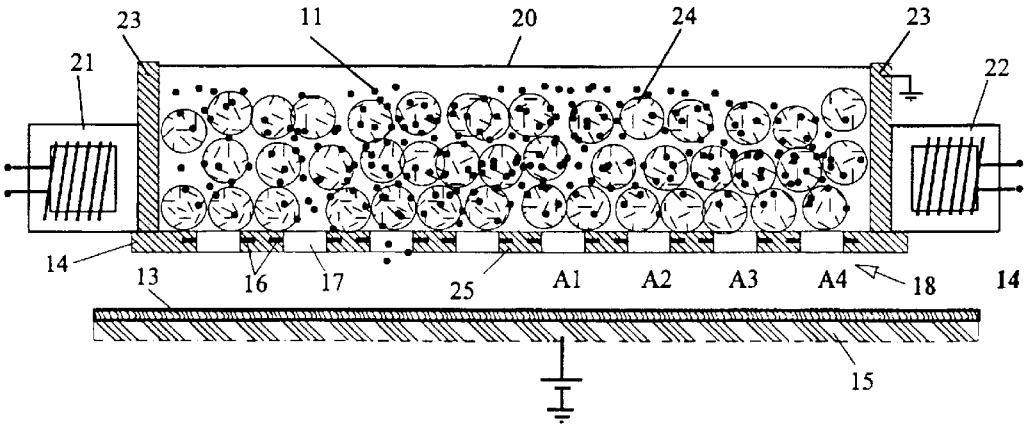
FIG. 3 schematically shows a cross-section view of a printer unit according to the present invention.

FIG. 3 shows a cross-section of part of a printer unit 10 according to the present invention. The printer unit 10 consists of the same elements shown in FIG. 1 with the developer roller replaced by a toner container 20. Toner container 20 has an open end portion that is preferably arranged in direct contact with the control electrode substrate 14. The casing 23 of the toner container is entirely or party, and at least in the area adjacent to the control electrode substrate 14 made of conducting or semiconducting material. At the end portion of the container, preferably adjacent to the control electrode substrate, electromagnet coils 21 and 22 are provided. The electrodes 16 of the control electrode unit 18 are covered by an insulating layer 25.

The toner container is filled partly with toner carriers 24, which have minimum dimensions greater than the diameter of apertures 17 in the control electrode substrate 14. According to the present embodiment the toner carriers 24 consist of iron, steel, or similar magnetic material, e.g. in powder or grain form, that is at least partly electrically conductive. Toner particles added at the top of the toner container 20 become electrically charged by contact with the toner carriers and attach themselves to the toner carrier surfaces in a way that is well known in the electrophotographic photocopier and printer technology. Mixing the toner particles and toner carriers before adding them to the toner container is also possible.

The electrically conductive portion of casing 23 is in contact with the conductive toner carriers 24. When the casing 23 is connected to a low or zero volt potential and the back electrode 15 is connected to for example 1500 volts, a strong electrostatic field is established between the toner carriers 24 and the back electrode. In this way the plane of the lowest layer of toner carriers 24 becomes a substantially planar electrode located at a more uniform distance from the control electrodes than the cylindrical developer roller described in the prior art. When control potentials are applied to control electrodes 16, the apertures are opened or closed electrostatically to the passage of toner particles as described previously for the prior art. Toner particles are drawn from the surface of the toner carriers by the electrostatic field. The toner particles are transported through the apertures to the surface of the information carrier to form a visible image.

Replacement toner particles are brought to the surface of the lower toner carriers by mechanical vibration of the toner carriers in the toner container. That vibration is provided by connecting an electrical potential to the electromagnet coils 21 and 22 to produce an alternating magnetic field that vibrates the magnetic toner carriers, causing the toner particles on the surface to fall by gravity to a lower toner carrier layer, replacing the toner particles used for printing.

Figure 4:
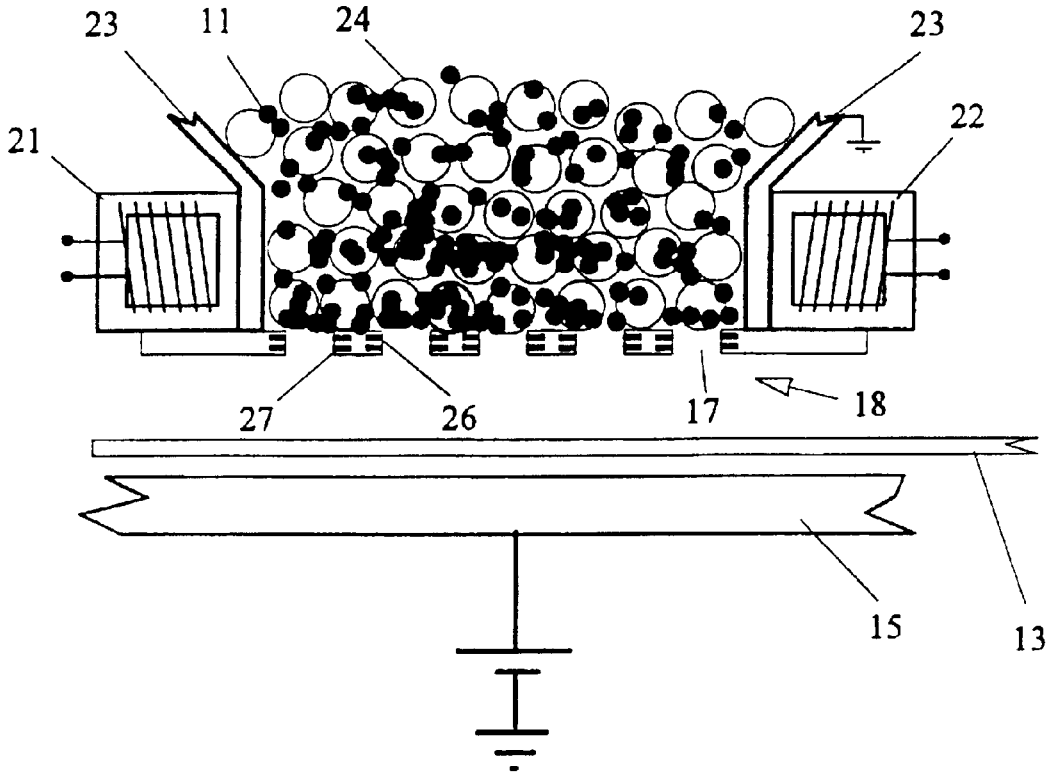
FIG. 4 schematically shows a cross-section view of another embodiment according to the present invention.

FIG. 4 shows an embodiment employing an electrode unit according to UK 2 108 432. The electrode unit incorporates two electrode layers 26 and 27. BY applying suitable voltage to the electrodes 26 and 27, an electric field is established to oppose or enhance the constant electrostatic field between the lower toner carriers and the back electrode. When the electrostatic field between the electrodes 26 and 27 opposes the constant electrostatic field, the aperture 17 is closed to passage of toner particles. When the electrostatic field between electrodes 26 and 27 is zero or in the same direction as the constant electrostatic field, the aperture 17 is opened to passage of toner particles. Those toner particles are attached to the information carrier 13. Coils 21 and 22 are energized to agitate replacement toner particles to the electrode unit.

The invention is not limited to the above described embodiments and shown in the enclosed drawing. Other embodiments within the scope of the claim can occur. The toner carrier can consist of any conducting, semiconducting, magnetic or non magnetic material and can be shaped as fibre or wool material or oblong wires. Toner particles may be composed of magnetic or nonmagnetic material. Toner feeding to the toner carriers can alternatively be achieved trough mechanical vibration, blowing, suction, electrostatic attraction forces or any combination of those forces. Number of toner containers, apertures and the back electrode can be varied, e.g. each aperture or group of apertures can be arranged with corresponding back electrode and/or container. It is also obvious for a person skilled in the art that the device and method according to the invention can be used in other printer types, such as laser printers, where a toner particle or similar marking material, substantially in powder form, or the like must be supplied to an information carrier.

| List of designation numeral |
|---|
| 10 Printer unit |
| 11 Toner particle |
| 12 Developer roller |
| 13 Information carrier |
| 14 Substrate |
| 15 Back electrode |

-continued

| List of designation numeral |
|---|
| 16 Electrode |
| 17 Aperture |
| 18 Electrode unit |
| 20 Toner container |
| 21 Electromagnetic coil |
| 22 Electromagnetic coil |
| 23 Casing |
| 24 Toner carrier material |
| 25 Insulating layer |
| 26 Electrode |
| 27 Electrode |

I claim:

1. A method for charging and feeding toner particles in a printing device which includes at least one printer unit, said printer unit comprising at least one container, one back electrode and one control electrode unit, said control electrode unit provided with apertures and electrodes, where the toner particles are transported to an information carrier, said information carrier insertable between said container and the back electrode, said method comprising the steps of:

providing a plurality of toner carriers distributed within said container, said toner carriers having a layer within said container substantially coplanar with said electrode unit, said toner carriers being at least partly conductive and having toner particles attached thereto;

bringing said layer of toner carriers substantially into direct contact with the control electrode unit; and successively feeding the toner particles towards the control electrode unit by means of an external force which redistributes said toner particles.

2. The method according to claim 1, wherein said external force comprises at least one of a magnetic force, an electrostatic force and a gravity force.

3. A device for charging and feeding toner particles in a printing device which includes at least one printer unit, said printer unit comprising at least one container, one back electrode and one control electrode unit, said control electrode unit having apertures and electrodes, where the toner particles are transported to an information carrier, said information carrier insertable between said container and the back electrode, said device cooperating with said container and comprising:

toner carriers distributed within said container, said toner carriers being at least partly conductive and having a layer within said container arranged substantially coplanar with said control electrode unit, said layer substantially contacting said control electrode unit; and means for producing an external force on said toner carriers to cause said toner carriers to move within said container.

4. The device according to claim 3, wherein said toner container is connected to at least one voltage supply.

5. The device according to claim 4, wherein the external force generating means comprises electromagnetic coils.

6. The device according to claim 5, wherein the toner carriers have a size selected to prevent the toner carriers from passing through the apertures.

7. The device according to claim 6, wherein the toner carriers comprise iron.

8. The device according to claim 6, wherein the toner carriers comprise steel.

9. The device according to claim 6, wherein the toner carriers comprise a magnetic material.

10. The device according to claim 3, wherein the control electrodes on one side of a substrate, said control electrodes at least partly surrounding the apertures.

11. The device according to claim 3, wherein the control electrodes are arranged on both sides of a substrate said electrodes at least partly surrounding the apertures.

12. The device according to claim 3, wherein said control electrode unit is insulated by an insulation layer and the toner carriers are at least partly in contact with the insulation layer.

13. The device according to claim 3, wherein said means for producing an external force on said toner carriers comprises means for generating electrostatic attraction forces.

14. The device according to claim 3, wherein said toner carriers comprise a conducting material.

15. The device according to claim 3, wherein the external force generating means comprises electromagnetic coils.

16. The device according to claim 15, wherein the toner carriers have a size selected to prevent the toner carriers from passing through the apertures.

17. The device according to claim 16, wherein the toner carriers comprise iron.

18. The device according to claim 16, wherein the toner carriers comprise steel.

19. The device according to claim 16, wherein the toner carriers comprise a magnetic material.

20. The device according to claim 3, wherein the toner carriers have a size selected to prevent the toner carriers from passing through the apertures.

21. The device according to claim 20, wherein the toner carriers comprise iron.

22. The device according to claim 20, wherein the toner carriers comprise steel.

23. The device according to claim 20, wherein the toner carriers comprise a magnetic material.

24. The device according to claim 3, wherein the control electrodes are embedded in a substrate, said control electrodes at least partly surrounding the apertures.

25. The device according to claim 3, wherein the means for producing an external force on said toner carriers comprises means for generating mechanical vibration.

26. The device according to claim 3, wherein the means for producing an external force on said toner carriers comprises means for blowing.

27. The device according to claim 3, wherein the means for producing an external force on said toner carriers comprises means for suction.

28. The device according to claim 3, wherein said toner carriers comprise a semiconducting material.

29. The device according to claim 3, wherein said toner carriers comprise a magnetic material.

30. The device according to claim 3, wherein said toner carriers comprise a nonmagnetic material.

31. The device according to claim 3, wherein said toner carriers are formed as a fiber material.

32. The device according to claim 3, wherein said toner carriers are formed as a wool material.

33. The device according to claim 3, wherein said toner carriers are formed as oblong wires.

34. A method for charging and feeding toner particles in a printing device which includes at least one printer unit, said printer unit comprising at least one container, one back electrode and one control electrode unit, said control electrode unit provided with apertures and electrodes, where the toner particles are transported to an information carrier, said information carrier insertable between said container and the back electrode, said method comprising the steps of:

filling said toner container with a first material and a second material, said first material being a plurality of toner carriers and said second material being said toner particles;

arranging a layer of said toner carriers within said container substantially coplanar to said electrode unit to dispense toner particles, said toner carriers being at least partly conductive;

bringing said layer of toner carriers substantially into direct contact with the control electrode unit; and successively feeding the toner particles towards the control electrode unit by means of an external force.

35. A device for charging and feeding toner particles in a printing device which includes at least one printer unit, said printer unit comprising at least one container, one back electrode and one control electrode unit, said control electrode unit having apertures and electrodes, where the toner particles are transported to an information carrier, said information carrier insertable between said container and the back electrode, said device cooperating with said container and comprising:

a first material and a second material provided in said toner container, said first material being a plurality of toner carriers and said second material being said toner particles;

a layer of said toner carriers within said container arranged substantially coplanar with said control electrode unit and substantially in contact with said control electrode unit; and means for producing an external force through said toner container.

* * * * *

UNITED STATES PATENT AND TRADEMARK OFFICE
CERTIFICATE OF CORRECTION

PATENT NO. : 6,017,116

DATED : January 25, 2000

INVENTOR : Ove Larson

It is certified that error appears in the above-identified patent and that said Letters Patent is hereby corrected as shown below:

In column 4 at line 34, change "force comprises at least one of" to --force is selected from the group consisting of--.

In column 4 at line 66, change "electrodes on one side" to --electrodes are arranged on one side--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*